US009235989B2

(12) United States Patent
Collum et al.

(10) Patent No.: US 9,235,989 B2
(45) Date of Patent: Jan. 12, 2016

(54) ADJUSTMENT OF A TRAFFIC SIGNAL CONTROL PLAN BASED ON LOCAL ENVIRONMENTAL CONDITIONS

(71) Applicant: Siemens Industry, Inc., Alpharetta, GA (US)

(72) Inventors: Brian Collum, Austin, TX (US); Benjamin Collar, Austin, TX (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 102 days.

(21) Appl. No.: 14/192,276

(22) Filed: Feb. 27, 2014

(65) Prior Publication Data

US 2015/0243164 A1 Aug. 27, 2015

(51) Int. Cl.
*G08G 1/07* (2006.01)

(52) U.S. Cl.
CPC ..... *G08G 1/07* (2013.01)

(58) Field of Classification Search
CPC ... B60W 40/00; G01C 21/3626; G07C 5/085; G08G 1/08; G08G 1/09; G08G 1/091; G08G 1/093; G08G 1/095; G08G 1/09675; G08G 1/161; G08G 1/164
USPC ..... 340/905, 911, 907, 914, 916, 923, 936, 340/929, 944, 990; 701/1, 23, 117, 400, 701/538
See application file for complete search history.

(56) References Cited

U.S. PATENT DOCUMENTS 3,602,882 A * 8/1971 Hill ..... G08G 1/08 340/923
3,710,312 A * 1/1973 Hill ..... G08G 1/08 340/923
4,370,718 A * 1/1983 Chasek ..... G08G 1/08 340/911
4,390,951 A * 6/1983 Marcy ..... G08G 1/08 340/914

(Continued)

FOREIGN PATENT DOCUMENTS

CN 102867420 A 1/2013
DE 102009042437 * 4/2010 ..... G08G 1/164

(Continued)

OTHER PUBLICATIONS

European Search Report mailed May 19, 2015 corresponding to European application No. 151567872 filed Feb. 26, 2015 (6 pages).

*Primary Examiner* — Paul Obiniyi

(57) ABSTRACT

Embodiments include a method for adjusting a signal control plan for a traffic signal at an intersection based on local environmental conditions is provided. The method includes operating the traffic signal based on a standard signal control plan, receiving an indication of an adverse environmental condition, and determining if the standard signal control plan should be adjusted based on the indication of the adverse environmental condition. Based on determining that the standard signal control plan should be adjusted based on the indication of the adverse environmental condition, the method includes creating a modified signal control plan based on the adverse environmental condition and the standard signal control plan and operating the traffic signal based on the modified signal control plan.

13 Claims, 5 Drawing Sheets

(56) References Cited

U.S. PATENT DOCUMENTS 6,353,792 B1 * 3/2002 Murthy ..... G08G 1/01 455/412.1
6,597,293 B1 * 7/2003 Harrison ..... B61L 29/24 340/944
2002/0008637 A1 1/2002 Lemelson
2003/0158651 A1 * 8/2003 Matsuo ..... G08G 1/0969 701/538
2004/0030458 A1 * 2/2004 Entenmann ..... G07C 5/085 701/1
2004/0158390 A1 * 8/2004 Mukaiyama ..... G08G 1/161 701/400
2005/0221759 A1 * 10/2005 Spadafora ..... G08G 1/09 455/41.2
2009/0135024 A1 * 5/2009 Park ..... G08G 1/096 340/929
2009/0273486 A1 * 11/2009 Sitbon ..... G08G 1/095 340/907
2009/0284395 A1 11/2009 Bushman
2011/0191011 A1 * 8/2011 McBride ..... H04L 1/0823 701/117
2013/0116915 A1 * 5/2013 Ferreira ..... G08G 1/163 701/117
2013/0300583 A1 * 11/2013 Wignot ..... G08G 1/08 340/907
2014/0097969 A1 * 4/2014 Ni ..... G08G 1/07 340/907
2014/0118168 A1 * 5/2014 Lee ..... G08G 1/096725 340/905
2015/0166069 A1 * 6/2015 Engelman ..... B60W 40/00 701/23

FOREIGN PATENT DOCUMENTS

DE 102009042437 A1 * 4/2010 ..... G08G 1/16
JP 2006331002 A * 12/2006
JP 2010102529 A * 5/2010
JP 2011170869 A * 9/2011

* cited by examiner

400

| 402 Condition | 404 Source | 406 Timestamp | 408 Rebroadcast | 410 Duplicate | 412 Counter |
|---|---|---|---|---|---|
| Ice | Sensor | 12:01:05 1/14/2014 | Y | N | NULL |
| Pot-hole | CV | 14:10:30 12/10/2013 | N | Y | 2 |
| | | | | | |
| | | | | | |

420

FIG. 4

ADJUSTMENT OF A TRAFFIC SIGNAL CONTROL PLAN BASED ON LOCAL ENVIRONMENTAL CONDITIONS

BACKGROUND

The present invention relates generally to traffic management system and more specifically to, adjustment of a traffic signal control plan based on local environmental conditions.

In general, traffic management systems are utilized to control the operation of traffic signals along arterial roads. The goal of the traffic management system is to maximize vehicle throughput on the arterial road while minimizing delays. Traffic signal controllers are used to control the operation of traffic signals along the arterial roads and to adjust the signal phasing and timing based on the time and day of the week. The traffic signal controller operates a traffic signal based on a signal control plan that dictates the signal phasing and timing.

While existing traffic management systems adjust signal phasing and timing based on the time and day of the week, these are not the only factors that affect traffic patterns and driver behaviors. One factor that has a large impact on traffic patterns and driver behaviors is the weather. However, existing traffic management systems are not designed to take into account the weather when adjusting signal phasing and timing.

SUMMARY

According to one embodiment, a method for adjusting a signal control plan for a traffic signal at an intersection based on local environmental conditions is provided. The method includes operating the traffic signal based on a standard signal control plan, receiving an indication of an adverse environmental condition, and determining if the standard signal control plan should be adjusted based on the indication of the adverse environmental condition. Based on determining that the standard signal control plan should be adjusted based on the indication of the adverse environmental condition, the method includes creating a modified signal control plan based on the adverse environmental condition and the standard signal control plan and operating the traffic signal based on the modified signal control plan.

According to another embodiment, a traffic signal controller having a processor that is configured to operate a traffic signal by preforming a method is provided. The method includes operating the traffic signal based on a standard signal control plan, receiving an indication of an adverse environmental condition, and determining if the standard signal control plan should be adjusted based on the indication of the adverse environmental condition. Based on determining that the standard signal control plan should be adjusted based on the indication of the adverse environmental condition, the method includes creating a modified signal control plan based on the adverse environmental condition and the standard signal control plan and operating the traffic signal based on the modified signal control plan.

According to yet another embodiment, roadside equipment for operating a traffic signal at an intersection includes a traffic signal controller that operates a traffic signal for the intersection. The traffic signal controller performs a method including receiving an indication of an abnormal condition of a road in a vicinity of the intersection, storing the abnormal condition in a memory of the roadside equipment, and broadcast a warning message notifying connected devices in the vicinity of the intersection of the abnormal condition based on a type of the abnormal condition.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

FIG. 4 is a block diagram of database used to store information relating to an intersection in accordance with an exemplary embodiment.

DETAILED DESCRIPTION

Exemplary embodiments include methods, systems and computer program products for adjusting a signal control plan of a traffic signal based on local environmental conditions. In exemplary embodiments, roadside equipment configured to operate a traffic signal for an intersection receives an indication of an adverse environmental condition in the area of the intersection and responsively adjusts the signal control plan of the traffic signal. For example, in response to receiving an indication that it is raining in the area of the intersection the roadside equipment may adjust the signal control plan to increase a yellow light time to give drivers additional time to stop and/or clear the intersection. In another example, in response to receiving an indication that there is a weather event which requires evacuation in the area of the intersection the roadside equipment may increase the length of the green light time of the signal control plan along an evacuation route to increase the number of travelers that can evacuate. In exemplary embodiments, the roadside equipment includes a memory that stores the received indications of an adverse environmental condition in addition to other information regarding the intersection.

Figure 1:
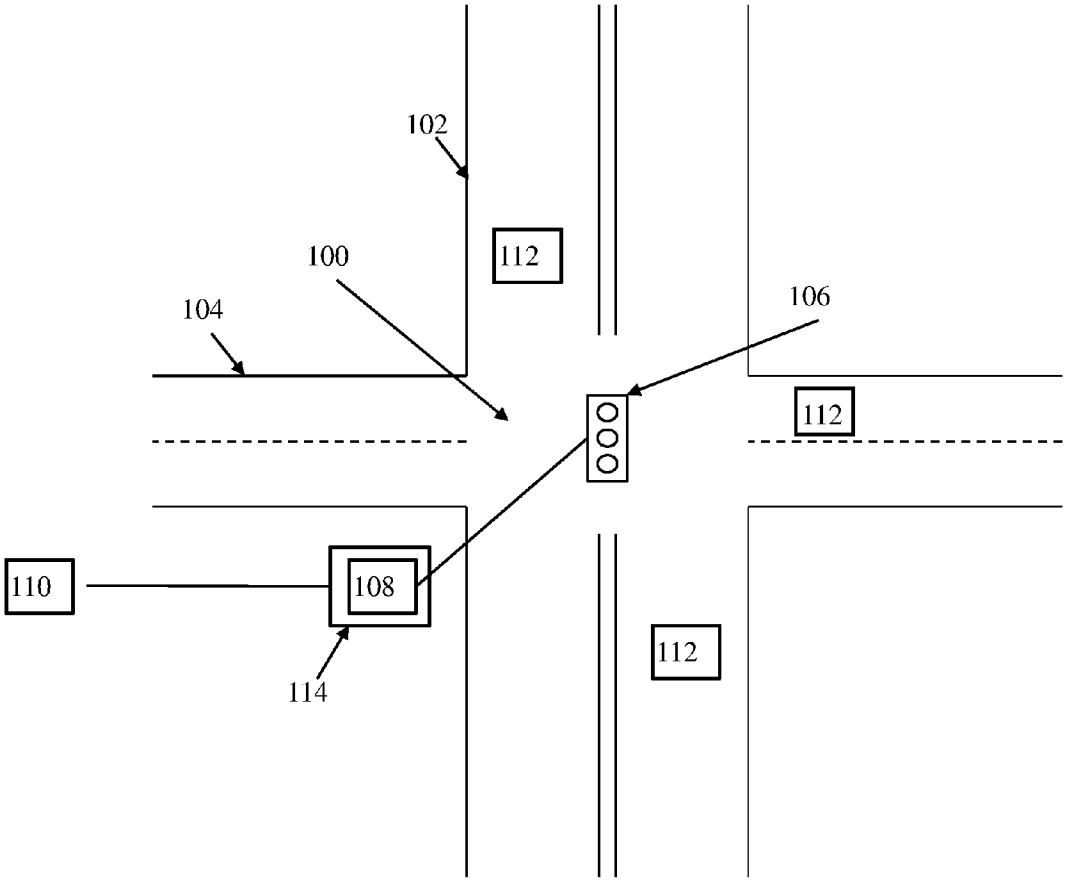
FIG. 1 is a schematic diagram illustrating an intersection in accordance with an exemplary embodiment.

Referring now to FIG. 1, a block diagram of an intersection 100 in accordance with an exemplary embodiment is shown. As illustrated, the intersection 100 of a main street 102 and a side street 104 includes a traffic signal 106 that is configured to control the flow of vehicles 112 through the intersection 100. In exemplary embodiments, the traffic signal 106 is controlled by a traffic signal controller 108, which is part of roadside equipment 114. In exemplary embodiments, the roadside equipment 114 is in communication with a traffic management system 110 and the vehicles 112 may be configured communicate with the roadside equipment 114 via wireless communication devices. In exemplary embodiments, the traffic management system 110 may be connected to the roadside equipment 114 by a fiber optic cable, copper wire, or by other suitable means. In exemplary embodiments, the traffic signal controller 108 may receive signal control plans from the traffic management system 110 which are used to govern the operation of the traffic signal 106 during different times of the day and days of the week.

Figure 2:
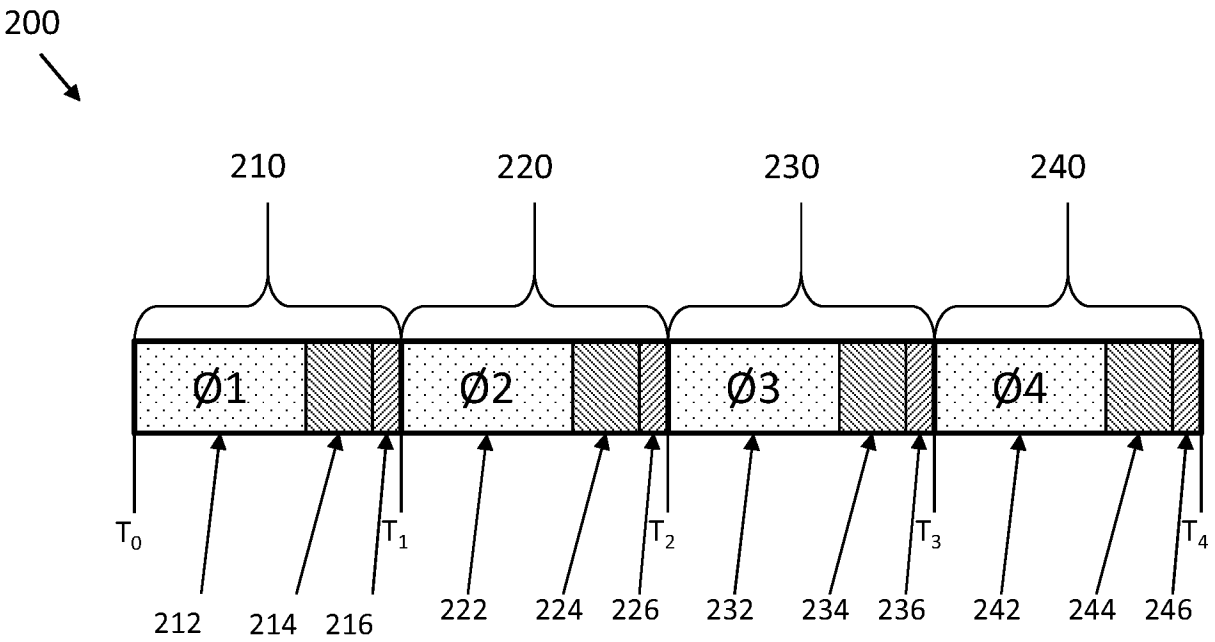
FIG. 2 is a block diagram illustrating a cycle of a signal control plan for an intersection in accordance with an exemplary embodiment.

Referring now to FIG. 2, a block diagram of a cycle 200 of a signal control plan in accordance with an exemplary embodiment is shown. As illustrated, the cycle 200 includes four phases of operation 210, 220, 230, 240. For example, the cycle 200 may include a first phase 210 that corresponds to a main street left turn traffic condition, a second phase 220 that corresponds to a main street through condition, a third phase 230 that corresponds to a side street left turn traffic condition, and a fourth phase 240 that corresponds to a side street through condition. As illustrated, the first phase 210, and the cycle 200, starts at time $T_0$, the second phase 220 starts at time $T_1$, the third phase 230 starts at time $T_2$, the fourth phase 240 starts at time $T_3$, the fourth phase 220, and the cycle 200, ends at time $T_4$ Accordingly, the period of the cycle, or cycle length, is defined as $T_4$-$T_0$.

Each phase 210, 220, 230, 240 includes three sub-phases that correspond to green light time 212, 222, 232, 242, yellow light time 214, 224, 234, 244, and red light time 216, 226, 236, 246. Although, the length of each phase 210, 220, 230, 240 is shown as approximately equal, it will be understood by those of ordinary skill in the art that the length of each phase 210, 220, 230, 240 may be different. Likewise, even though the green light time 212, 222, 232, 242 of each phase 210, 220, 230, 240 is shown as approximately equal, it will be understood by those of ordinary skill in the art that the green light time 212, 222, 232, 242 of each phase 210, 220, 230, 240 may be different.

In exemplary embodiments, a standard signal control plan received by the traffic signal controller includes a cycle for the traffic signal that is continually repeated. In exemplary embodiments, the traffic signal controller is configured to employ different standard signal control plans during different times of the day and on different days of the week. For example, during morning rush hour it may be desirable for a longer portion of the cycle to be devoted to one phase of the cycle than during lunch time. Accordingly, the traffic signal controller may be configured to switch between standard signal control plans multiple times during the day. In exemplary embodiments, the traffic signal controller is configured to selectively modify the standard signal control plan that is currently being executed based on receiving an indication of an adverse environmental condition in the area of the intersection.

Figure 3:
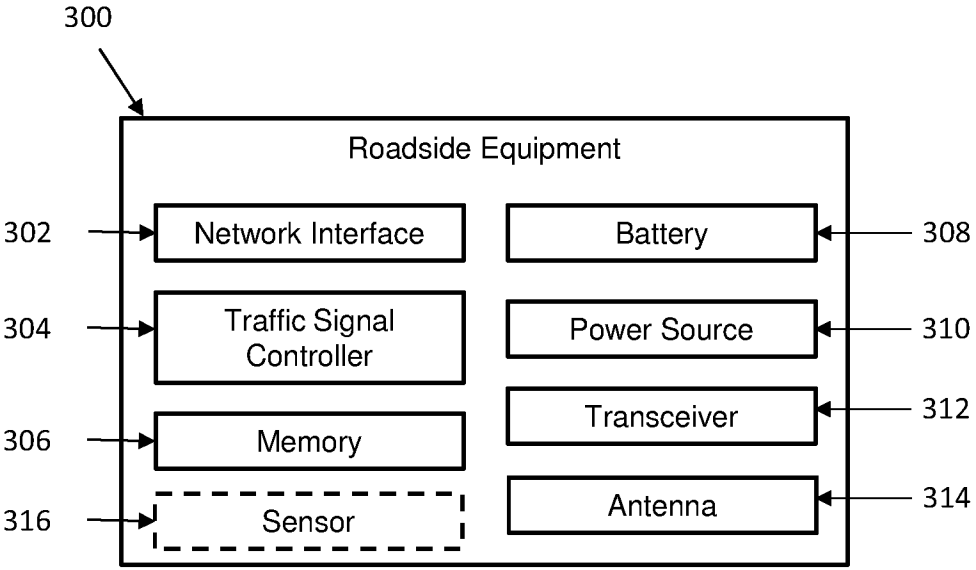
FIG. 3 is a block diagram of roadside equipment in accordance with an exemplary embodiment.

Referring now to FIG. 3, a block diagram of roadside equipment 300 in accordance with an exemplary embodiment is shown. As illustrated, the roadside equipment 300 includes a network interface 302, a traffic signal controller 304, a memory 306, a battery 308, a power source 310, a transceiver 312, and an antenna 314. In one embodiment, the network interface 302 is configured to connect the roadside equipment 300 to a traffic management system via an Ethernet cable. The roadside equipment 300 is configured to receive information from the traffic management system and to use the traffic signal controller 304 and the memory 306 to process and store the received information.

In exemplary embodiments, the memory 306 may include any of a wide variety of memory devices including volatile and non-volatile memory devices. The memory 306 may be used to store signal plans received from the traffic management system and to store additional information relating to the intersection. In exemplary embodiments, the additional information relating to the intersection may be received from connected devices. As used herein, the term connected devices refers to any device which has the necessary wireless communications equipment to send and/or receive messages from roadside equipment 300. Likewise, the term connected vehicle refers to a vehicle which has the necessary wireless communications equipment to send and/or receive messages from roadside equipment 300.

In exemplary embodiments, the network interface 302 may be configured to receive information from the Internet either directly or indirectly via the traffic management system. For example, the traffic management system may be configured to monitor weather conditions and to selectively send messages to roadside equipment 300 that indicate an adverse environmental condition in the geographic area of the roadside equipment 300. In exemplary embodiments, the network interface 302 may be configured to communicate with a web service that uses social media or other sources to gather information regarding the weather conditions or road conditions in the geographic area of the roadside equipment 300.

In exemplary embodiments, the roadside equipment 300 may include one or more sensors 316 that are configured to monitor the local environmental conditions around the roadside equipment 300. In exemplary embodiments, the sensors 316 may include, but are not limited to, a thermometer, a barometer, an anemometer, a hygrometer, wind vanes, video cameras, or the like. The traffic signal controller 304 monitors the output of the sensors 316 to determine the presence of an adverse environmental condition In exemplary embodiments, the local environmental conditions may include but are not limited to, rain, snow, ice, fog or the like.

In exemplary embodiments, the roadside equipment 300 is configured to receive power from power source 310 and to charge a battery 308. The battery 308 is configured to provide power to the roadside equipment 300 in the event of an interruption or failure of the power source 310. In exemplary embodiments, the power source 310 may be a power over Ethernet power source and the network interface 302 may be configured to receive both data and power over an Ethernet connection. In exemplary embodiments, the battery 308 may be a lead acid battery, a lithium ion battery, a nickel cadmium battery or the like.

In exemplary embodiments, the roadside equipment 300 includes multiple transceivers 312 and antennas 314 which are each configured to communicate on different communications channels, or frequencies. In other embodiments, the roadside equipment 300 may be configured to use a single antenna 314 and transceiver 312 to communicate over a range of communications channels, or frequencies. In exemplary embodiments, the transceivers 312 and antennas 314 of the roadside equipment 300 are configured to communicate with connected vehicles and other connected devices within range of the roadside equipment 300. For example, the transceivers 312 may include a 5.9 GHz short range wireless communications device that is capable of both sending and receiving messages from nearby connected vehicles.

In one embodiment, vehicles may be configured to detect adverse environmental conditions, such as rain, ice or snow on the road, or the like through the use of one or more known sensors on the vehicle. For example, a vehicle may detect that the road is wet or icy based on the activation of its ABS. Upon detecting such an adverse environmental condition, the vehicle may periodically or continuously broadcast a short range message indicating the detected adverse environmental condition. In exemplary embodiments, such messages may be received by the roadside equipment 300 and by other connected devices that are within range of the vehicle.

In exemplary embodiments, the roadside equipment 300 may store these messages in the memory 306 and may rebroadcast these messages to other connected devices that are within range of the roadside equipment 300. In one embodiment, as the messages are received the adverse environmental condition reported may be stored in a database in the memory 306 with a timestamp indicating when the message reporting the adverse environmental condition was received. The roadside equipment 300 may be configured to broadcast a message warning of the reported adverse environmental condition for a predetermined period of time from the timestamp. In exemplary embodiments, if multiple messages are received indicating the same adverse environmental condition, the timestamp for the adverse environmental condition will be updated with the most recent time at which a message was received.

Referring now to FIG. 4, a block diagram of database 400 used to store information relating to an intersection in accordance with an exemplary embodiment is shown. The information relating to the intersection may include, but is not limited to, an environmental condition in the area of the intersection, a condition of the road, or any other abnormal condition relating to the intersection. In exemplary embodiments, the database 400 is stored in the memory of a roadside equipment for an intersection and stores a plurality of records 420 that each correspond to a condition of the intersection. In exemplary embodiments, each of the records 420 can include a condition type 402, a source 404, a timestamp 406, a rebroadcast flag 408, a duplicate flag 410, and a counter 412. In exemplary embodiments, the condition type 402 field is used to store the reported condition of the road at the intersection and may include, but is not limited to, wet, ice, pot hole, or the like. In exemplary embodiments, the source 404 filed is used to store the source of the reported condition type 402 of the road at the intersection and may include, but is not limited to, a connected vehicle (CV), a sensor, the internet, or the like. In exemplary embodiments, the timestamp 406 filed is used to store the most recent time that the condition type 402 of the road at the intersection was reported.

In exemplary embodiments, the roadside equipment may broadcast a warning message to notify connected devices in the area of the intersection of the condition type 402. The rebroadcast flag 406 is used to store a flag that indicates if the roadside equipment will broadcast the warning message. In exemplary embodiments, the determination of whether the roadside equipment will broadcast a warning message for the condition is based on the type the condition type 402. For example, the roadside equipment may broadcast warning messages relating to icy conditions but may not broadcast warning messages relating to pot holes. In other embodiments, the roadside equipment may transmit a notification of the condition to a traffic management system based on the condition type 402. For example, the roadside equipment may transmit a notification to a traffic management system relating to pot holes but may not transmit a notification relating to icy conditions.

In exemplary embodiments, the duplicate flag 410 is used to store a flag that indicates if the condition type 402 has been reported more than once. The counter 412 field is used to store the number of times the condition has been reported if the duplicate flag 410 indicates that the condition has been reported more than once. In exemplary embodiments, the determination of whether the roadside equipment will broadcast a warning message for the condition type 402 may also be based on the source and number of times that a condition type 402 has been reported.

Those of skill in the art will recognize that not all details are shown in the simplified block diagram shown in FIG. 3. In exemplary embodiments, the antenna 314 may be dedicated to a single transceiver 312, or may be connected to be shared with other components. The traffic signal controller 304 may be configured to perform only the processes described herein, or can also be configured to perform other processes for the operation and management the roadside equipment 300. The various components of FIG. 3 could be constructed as separate elements connected to communicate with each other or two or more of these components could be integrated into a single device.

Figure 5:
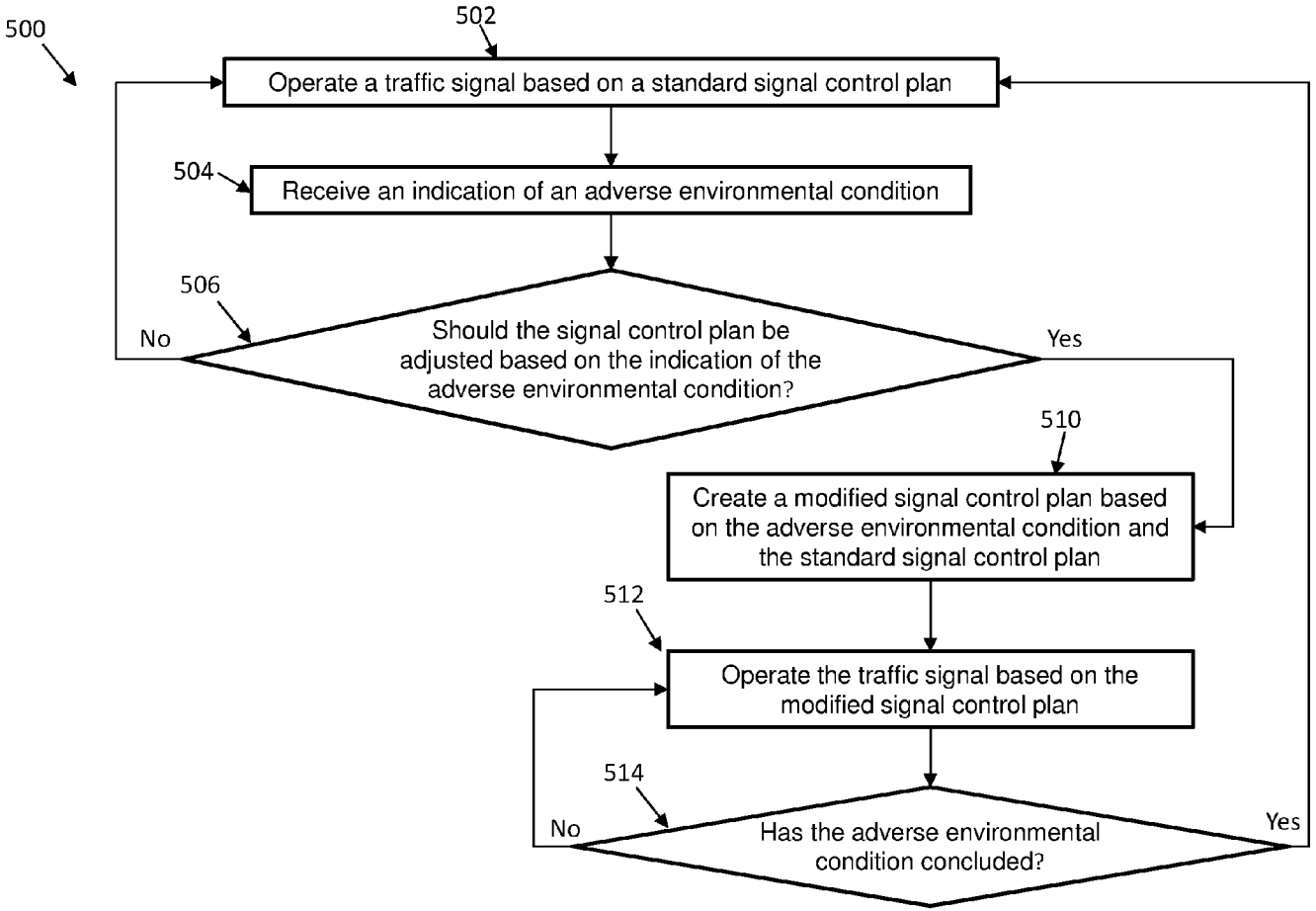
FIG. 5 is a flow chart diagram illustrating a method for adjusting a signal control plan based on local environmental conditions in accordance with an exemplary embodiment.

Referring now to FIG. 5, a flow chart diagram illustrating a method 500 for adjusting a signal control plan based on local environmental conditions in accordance with an exemplary embodiment is shown. As shown at block 502, the method 500 includes operating a traffic signal based on a standard signal control plan. Next, as shown at block 504, the method includes receiving an indication of an adverse environmental condition in the area of the traffic signal. In exemplary embodiments, the indication of the adverse environmental condition may be received from a sensor of the roadside equipment, from a vehicle in proximity to the roadside equipment, from the Internet, or from any other of a variety of sources. In exemplary embodiments, the adverse environmental condition may include, but is not limited to, rain, fog, snow or ice in the area of the traffic signal.

As shown at decision block 506 the method 500 includes determining if the signal control plan should be adjusted based on the indication of the adverse environmental condition. In exemplary embodiments, the determination of whether the signal control plan should be adjusted based on the adverse environmental condition may be based one or more of: on the severity of the adverse environmental condition; the location of the adverse environmental condition; the number of indications received of the adverse environmental condition; and the source of the indication of an adverse environmental condition. For example, if the adverse environmental condition is detected by a sensor connected the roadside equipment the signal control plan may be immediately adjusted. In another example, if the notification of the adverse environmental condition is received from a weather alert service via the Internet, the roadside equipment may be configured to wait for a local sensor or vehicle to report the adverse environmental condition.

Continuing with reference to FIG. 5, if the signal control plan should not be adjusted based on the indication of the adverse environmental condition, the method 500 proceeds to block 502 and operates the traffic signal based on the standard signal control plan. Otherwise, the method 500 proceeds to block 510 and creates a modified signal control plan based on the adverse environmental condition and the standard signal control plan. Next, as shown at block 512 the method 500 includes operating the traffic signal based on the modified signal control plan. As shown at decision block 514, the method 500 includes determining if the adverse environmental condition concluded. If the adverse environmental condition has concluded, the method 500 returns to block 502 and operates the traffic signal based on the standard signal control plan. If the adverse environmental condition has not concluded, the method 500 returns to block 512 and operates the traffic signal based on the modified signal control plan.

In one embodiment, the determination of whether the adverse environmental condition has concluded may be based on a predetermined period of time elapsing since the last indication of adverse environmental condition was received. In another embodiment, the determination of whether the adverse environmental condition has concluded may be based on receiving a reading from a sensor that indicates that the environmental condition in the area of the traffic signal has returned to normal. In yet another embodiment, the determination of whether the adverse environmental condition has concluded may be based upon the expiration of severe weather advisory or warning.

In one embodiment if the adverse environmental condition in the area of the intersection is ice or snow on the road, rain or heavy fog, the signal control plan may be adjusted to increase the length of yellow light times. By increase the length of yellow light times the chance of accidents from cars sliding into the intersection can be reduced. In another embodiment if the adverse environmental condition is a weather event which requires evacuation, such as a hurricane, the signal control plan may be adjusted to increase the length of the green light time along an evacuation route to increase the number of travelers that can evacuate.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The flow diagrams depicted herein are just one example. There may be many variations to this diagram or the steps (or operations) described therein without departing from the spirit of the invention. For instance, the steps may be performed in a differing order or steps may be added, deleted or modified. All of these variations are considered a part of the claimed invention.

While the preferred embodiment to the invention had been described, it will be understood that those skilled in the art, both now and in the future, may make various improvements and enhancements which fall within the scope of the claims which follow. These claims should be construed to maintain the proper protection for the invention first described.

What is claimed is:

1. A method for adjusting a signal control plan for a traffic signal at an intersection based on local environmental conditions, the method comprising:

operating the traffic signal based on a standard signal control plan;

receiving an indication of an adverse environmental condition;

determining if the standard signal control plan should be adjusted based on the indication of the adverse environmental condition;

based on determining that the standard signal control plan should be adjusted based on the indication of the adverse environmental condition, creating a modified signal control plan based on the adverse environmental condition and the standard signal control plan;

operating the traffic signal based on the modified signal control plan by changing a length of at least one of a yellow light time and a green light time within a length of a phase that includes at least three sub-phases that correspond to a red light time and the yellow light time and the green light time;

determining whether the adverse environmental condition concluded;

based on determining that the adverse environmental condition concluded, operating the traffic signal based on the standard signal control plan; and based on determining that the adverse environmental condition has not concluded, operating the traffic signal based on the modified signal control plan, wherein the indication of the adverse environmental condition is received from a sensor connected to roadside equipment disposed at the intersection, and wherein the determination of whether the signal control plan should be adjusted based on the adverse environmental condition is based on one or more of:

a severity of the adverse environmental condition;

a location of the adverse environmental condition;

a number of indications received of for the adverse environmental condition; and a source of the indication of an adverse environmental condition.

2. The method of claim 1, further comprising:

based on determining that the standard signal control plan should not be adjusted based on the indication of the adverse environmental condition operates the traffic signal based on the standard signal control plan.

3. The method of claim 1, wherein the indication of the adverse environmental condition is received from a vehicle in range of roadside equipment disposed at the intersection.

4. The method of claim 1, wherein the indication of the adverse environmental condition is received from a traffic management system.

5. The method of claim 1, wherein the adverse environmental condition comprises at least one of rain, fog, snow or ice in a vicinity of the traffic signal.

6. A traffic signal controller comprising:

a processor configured to operate a traffic signal, the processor configured to perform a method comprising:

receiving a standard signal control plan;

operating the traffic signal based on the standard signal control plan;

receiving an indication of an adverse environmental condition;

determining if the standard signal control plan should be adjusted based on the indication of the adverse environmental condition;

based on determining that the standard signal control plan should be adjusted based on the indication of the adverse environmental condition, creating a modified signal control plan based on the adverse environmental condition and the standard signal control plan;

operating the traffic signal based on the modified signal control plan by changing a length of at least one of a yellow light time and a green light time within a length of a phase that includes at least three sub-phases that correspond to a red light time and the yellow light time and the green light time;

determining whether the adverse environmental condition concluded;

based on determining that the adverse environmental condition concluded, operating the traffic signal based on the standard signal control plan; and based on determining that the adverse environmental condition has not concluded, operating the traffic signal based on the modified signal control plan, wherein the indication of the adverse environmental condition is received from a sensor connected to roadside equipment disposed at the intersection, and wherein the determination of whether the signal control plan should be adjusted based on the adverse environmental condition is based on one or more of:

a severity of the adverse environmental condition;

a location of the adverse environmental condition;

a number of indications received of for the adverse environmental condition; and a source of the indication of an adverse environmental condition.

7. The traffic signal controller of claim 6, wherein the method further comprises:

based on determining that the standard signal control plan should not be adjusted based on the indication of the adverse environmental condition operates the traffic signal based on the standard signal control plan.

8. The traffic signal controller of claim 6, wherein the indication of the adverse environmental condition is received from a vehicle in range of roadside equipment disposed at the intersection.

9. The traffic signal controller of claim 6, wherein the indication of the adverse environmental condition is received from a traffic management system.

10. The traffic signal controller of claim 6, wherein the adverse environmental condition comprises at least one of rain, fog, snow or ice in a vicinity of the traffic signal.

11. A roadside equipment for operating a traffic signal at an intersection, the roadside equipment comprising:

a traffic signal controller that operates a traffic signal for the intersection, the traffic signal controller performs a method comprising:

receiving an indication of an abnormal condition of a road in a vicinity of the intersection;

storing the abnormal condition in a memory of the roadside equipment;

broadcasting a warning message notifying connected devices in the vicinity of the intersection of the abnormal condition based on a type of the abnormal condition;

using a duplicate flag to store a flag that indicates if a condition type has been reported more than once;

using a counter field to store a number of times a condition has been reported if the duplicate flag indicates that the condition type has been reported more than once determining whether the abnormal condition concluded;

based on determining that the abnormal condition concluded, operating the traffic signal based on a standard signal control plan; and based on determining that the abnormal condition has not concluded, operating the traffic signal based on a modified signal control plan, wherein the indication of the abnormal condition is received from a sensor connected to the roadside equipment disposed at an intersection, and wherein the determination of whether a signal control plan should be adjusted based on the abnormal condition is based on one or more of:

a severity of the abnormal condition;

a location of the abnormal condition;

a number of indications received of for the abnormal condition; and a source of the indication of an abnormal condition.

12. The roadside equipment of claim 11, wherein the method further comprises transmitting a notification of the abnormal condition to a traffic management system based on the type of the abnormal condition.

13. The roadside equipment of claim 11, wherein broadcasting the warning message notifying connected devices in the vicinity of the intersection of the abnormal condition is further based on a source of the indication of the abnormal condition.

* * * * *